United States Patent [19]

Krogsrud

[11] Patent Number: 4,537,551

[45] Date of Patent: Aug. 27, 1985

[54] METHOD AND MEANS OF CHARGING ELECTROTHERMIC SMELTING FURNACES

[75] Inventor: Harald Krogsrud, Gjettum, Norway

[73] Assignee: Elkem a/s, Oslo, Norway

[21] Appl. No.: 488,418

[22] Filed: Apr. 25, 1983

[30] Foreign Application Priority Data

May 3, 1982 [NO] Norway ..... 821454

[51] Int. Cl.[3] ..... F23K 3/00

[52] U.S. Cl. ..... 414/199; 414/786; 373/81; 222/355; 222/370

[58] Field of Search ..... 414/160, 199, 200, 206, 414/293, 301, 786; 373/79, 81; 222/354, 355, 370

[56] References Cited

U.S. PATENT DOCUMENTS

| | | | |
|---|---|---|---|
| 1,496,232 | 6/1924 | Klugh | 363/81 |
| 1,639,415 | 8/1927 | Poplawski | 222/355 X |
| 2,738,373 | 3/1956 | Alexander | 373/81 |
| 2,944,707 | 7/1960 | Steinmetz | 222/370 X |
| 3,285,438 | 11/1966 | Howell et al. | 414/301 X |
| 4,405,340 | 9/1983 | Küpfer et al. | 414/160 X |
| 4,437,613 | 3/1984 | Olson | 414/301 X |

*Primary Examiner*—Robert G. Sheridan
*Assistant Examiner*—David A. Bucci
*Attorney, Agent, or Firm*—Lucas & Just

[57] ABSTRACT

In charging electrothermic smelting furnaces the charge is fed batchwise to the furnace pot through annular charging units arranged more or less concentrically around each electrode. The charge is supplied to each annular charging unit which surrounds each electrode and consists of a rotatable chamber which comprises at least one bottom member and two substantially vertical side walls. The bottom member and the walls are rotated together for supply of charge to the chamber, then the bottom of the chamber is rotated separately from the walls whereby the charge contained between the walls of the chamber is allowed to fall into the furnace pot through at least one closable opening in said bottom member.

12 Claims, 3 Drawing Figures

METHOD AND MEANS OF CHARGING ELECTROTHERMIC SMELTING FURNACES

Figure 1:
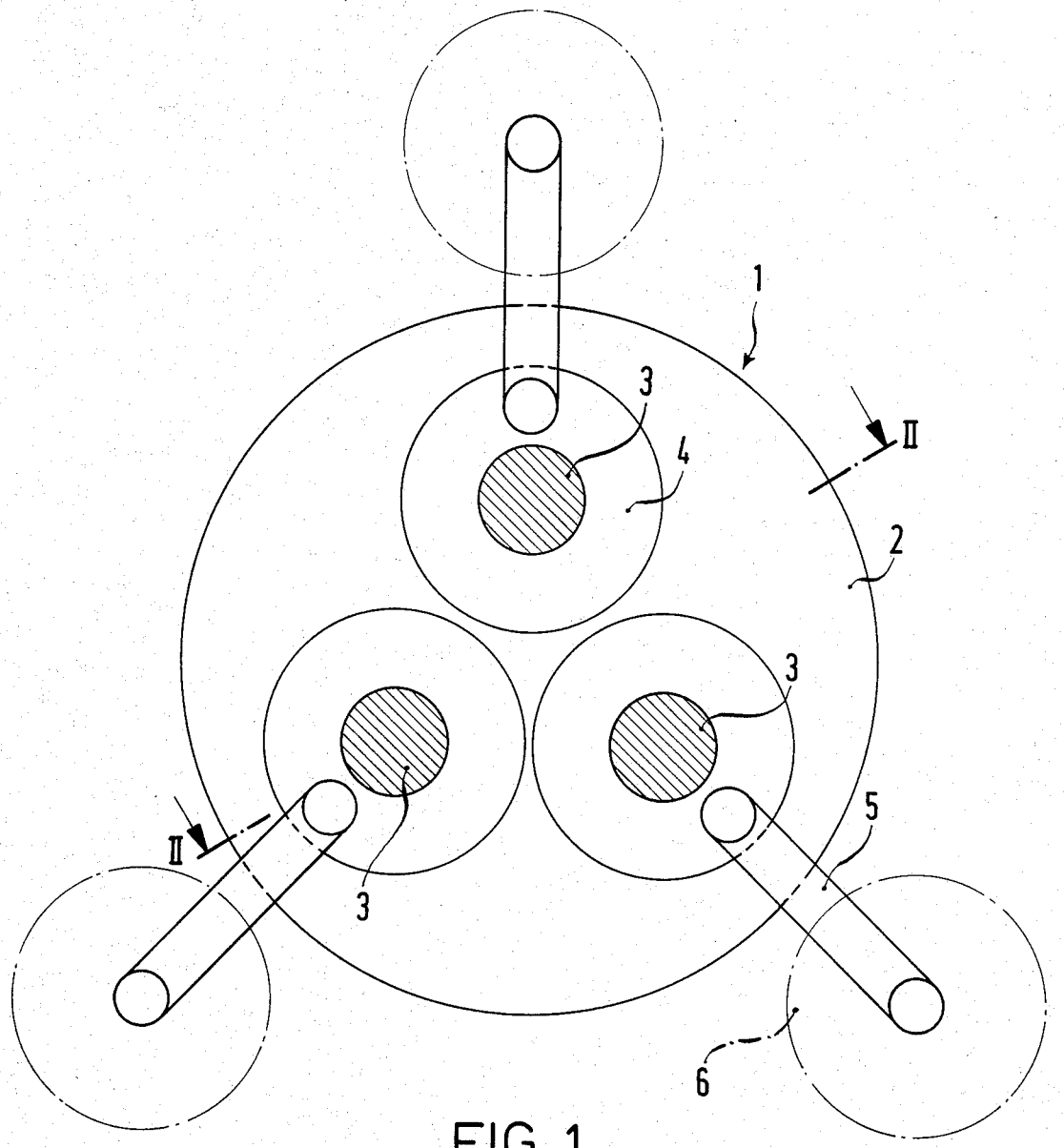

The present invention relates to a method and apparatus for charging electrothermic smelting furnaces. The charging method and apparatus according to the present invention is of a kind where the raw materials are delivered to the furnace through charging openings in the smokehood or in the furnace roof. In particular, but not exclusively, the method and apparatus according to the present invention are well suited for charging closed smelting furnaces.

An object of the invention is to provide a method and means for charging electrothermic smelting furnaces that makes it possible to feed the charge evenly and closely around the periphery of each electrode. Another object of the invention is to provide a charging means which is robust and needs as little maintenance work as possible and where maintenance work can be carried out without any downtime of the smelting furnace. An additional object of the invention is to provide a method and means for charging electrothermic smelting furnaces where the possibility for segregation of the mixed raw materials is avoided.

In closed electrothermic smelting furnaces for production of ferroalloys, pig iron and calcium carbide, the three electrodes extend through openings in the furnace roof. Charge is fed to the furnace through steel pipes or shafts which also extend through the furnace roof. The mixed raw materials are usually stored in bins or silos arranged above the furnace. Typically there is one bin or silo per charging pipe. In conventional furnaces there are three or four charging pipes for each electrode. The lower ends of the charging pipes are arranged peripherally around the electrodes. This implies that for a conventional furnace with three electrodes, there are nine to twelve charging pipes and the same number of openings for the charging pipes in the furnace roof.

The conventional method of charging electrothermic smelting furnaces is to allow selfcharging of the furnace, i.e. the charge feeds into the furnace by gravity at the same rate as the charge inside the furnace sinks down and reacts. A silo with a capacity of, for example, eight hours consumption of mixed charge, is arranged above the furnace and connected to the charging pipes. The mixed charge is transported from a mixing and weighing station to the silo by means of transporting systems.

Alternatively, the furnace can be charged in other conventional ways. For example the mixed raw materials can be charged in batches into the furnace via gates, valves or similar equipment, or through annular shafts around each electrode. In the last mentioned charging system, a plurality of steel pipes feed the mixed raw material into the shafts and the raw materials are then distributed around each electrode. Such annular shafts can either be open or closed in order to obtain gas-tight charging.

These previously known charging systems do not satisfy the present requirement for a gas-tight charging system for closed furnaces which are to be operated at a pressure of 10 mm water column above atmospheric pressure. Further, the known charging systems occupy a considerable space, are expensive, and require frequent maintenance work.

In accordance with the present invention there is provided a method and apparatus for charging electrothermic furnaces where the disadvantages and the drawbacks of the previously known charging systems have been overcome. The charging means according to the present invention further fulfill the demand for gas-tight charging of closed furnaces in such a way that the furnace can be operated at a pressure of at least 10 mm of water column above atmospheric pressure. In the charging apparatus according to the present invention, one silo and one charging pipe are sufficient to charge the furnace.

According to the present invention an annular chamber system is provided around each of the electrodes. The annular chambers are integral parts of the furnace roof and also form parts of a gas-tight seal between the furnace roof and the electrodes. Each annular chamber surrounds the electrode holder and comprises a bottom member and two substantially vertical, concentric walls. The bottom member and the walls are rotatable around the electrode. At least the bottom member of the chamber is connected to a rotation mechanism in such a way that the bottom member can be rotated separately or together with the walls. The bottom of the chamber has at least one closable opening. This opening communicates with the furnace pot below the annular chamber. Raw materials are fed to the annular chamber preferably through one stationary charging pipe. When the furnace is charged, the annular chamber is first rotated to fill the chamber with mixed raw materials. The bottom of the chamber is then rotated separately whereby the mixed raw materials in the chamber fall into the furnace through the at least one opening in the bottom of the chamber.

According to one embodiment of the present invention, the chamber is first rotated 360° in one direction to fill the chamber with mixed raw materials. The materials in the chamber are then fed to the furnace by rotating only the bottom of the chamber 360° in the same direction. The direction of rotation is then reversed and a new batch of raw materials is fed to the furnace in similar fashion. Thus raw materials are fed to the furnace, by rotating the system $2° \times 360°$ in one direction, then reversing the direction of rotation and rotating the system $2° \times 360°$ in the other direction.

The charging method and apparatus according to the present invention can favorably be used in connection with zone charging of smelting furnaces. For zone charging the bottom and the vertical walls of the chamber preferably have independent systems of rotation. When zone charging is being used, only the charge in a preselected sector of the chamber is fed to the furnace and this sector of the chamber is again filled with raw materials.

The charging means according to the present invention can also include more than one feeding pipe for feeding raw materials to the annular chamber. With an arrangement of a plurality of feeding pipes, separate ingredients in the mix can be fed to preselected zones in the annular chamber. In this way corrections of the mix can be made without any timedelay.

Figure 2:
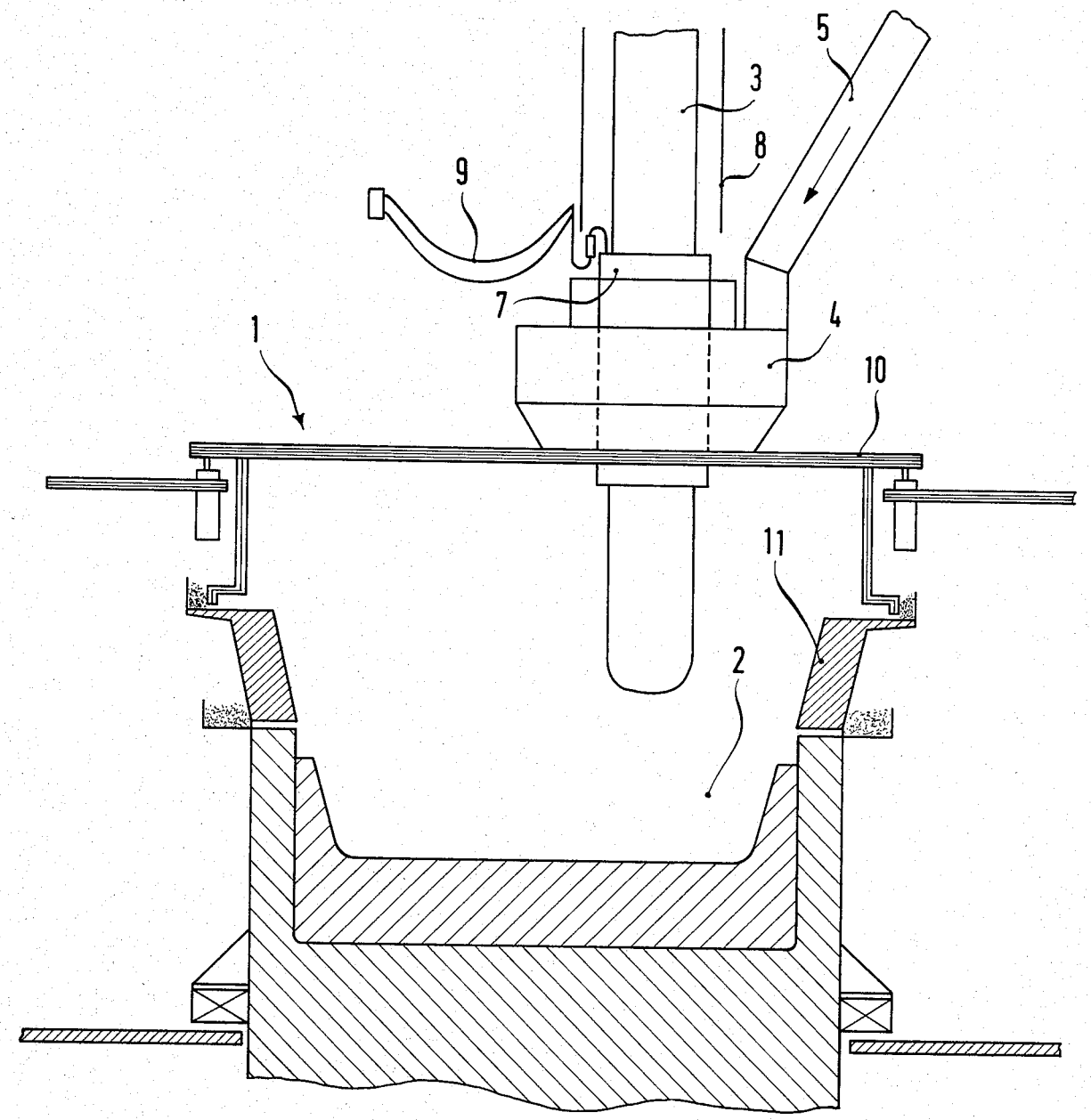

For more complete understanding of the present invention, reference is made to the accompanying drawings wherein;

FIG. 1 is a top plan view showing an electrothermic smelting furnace with three electrodes and with three silos for the mixed raw materials, FIG. 2 is a vertical sectional view of the furnace taken on line II—II in FIG. 1. In FIG. 2 only one of the electrodes is shown; and FIG. 3 is an enlarged vertical view of the electrode shown in FIG. 2, which shows the charging means according to the present invention.

FIG. 1 is a top plan view showing an electrothermic smelting furnace 1 comprising a furnace pot 2 and three electrodes 3. The electrodes 3 run through a furnace roof 10 and down into the furnace pot 2. Around each electrode 3 there is arranged an annular charging unit 4 according to the present invention. Charge is fed to the annular charging unit 4 from a silo 6 through steel pipes 5. The furnace can be closed, open or semiclosed.

FIG. 2 is a vertical sectional view of the furnace 1 taken on line II—II in FIG. 1. Only one of the electrodes 3 is shown on FIG. 2. The electrode 3 is held by an electrode holder 7 and a suspension frame 8. Electric current is supplied to the furnace through wires 9. As shown on FIG. 2, the furnace 1 comprises a furnace pot 2 and a furnace roof 10. The furnace pot 2 is horizontally split into two parts and the upper part 11 can be rotated. The parts of the furnace pot 2 and of the furnace roof 10 where there is any relative movement are furnished with gas-tight seals (not shown).

Figure 3:
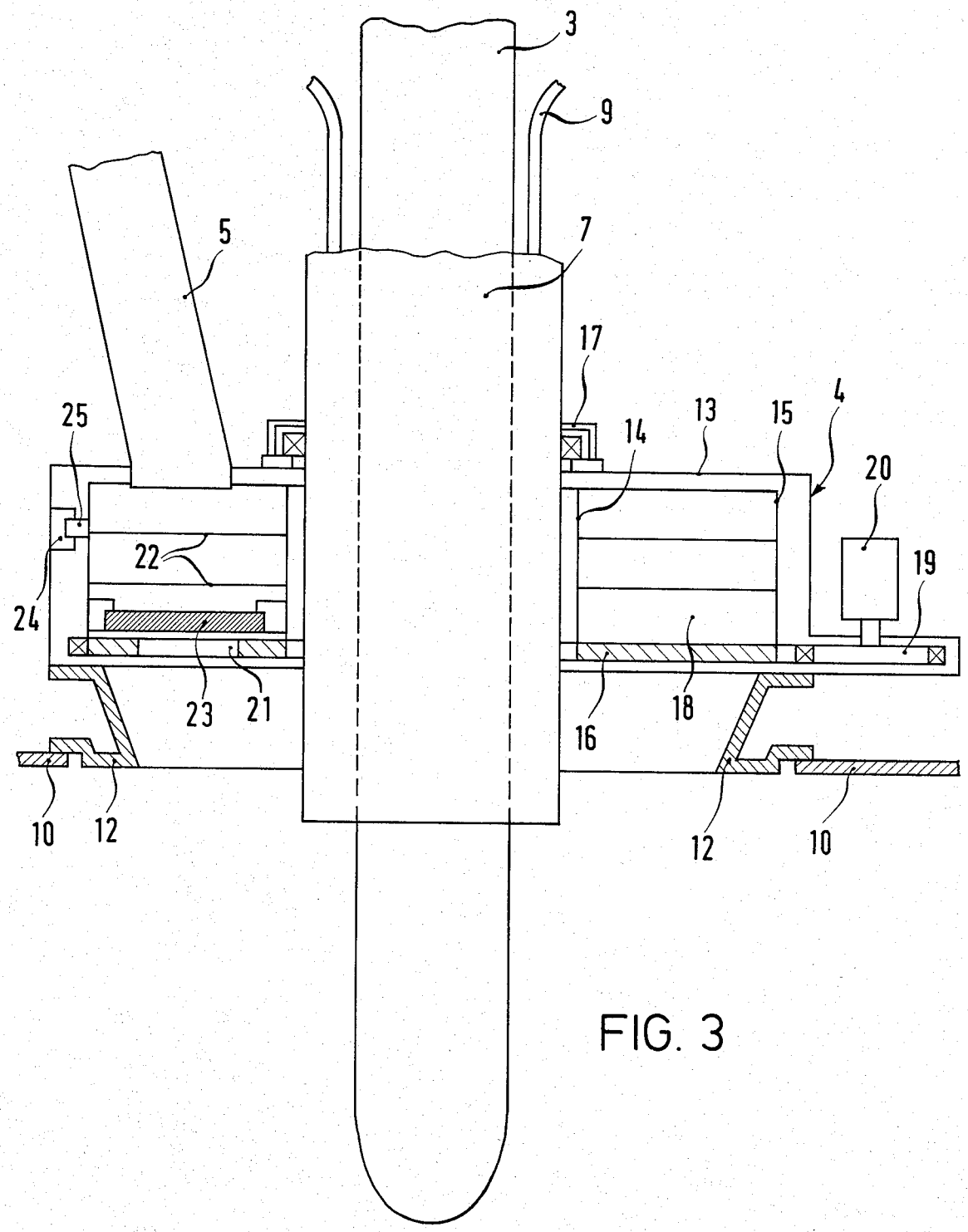

FIG. 3 is an enlarged vertical view of the electrode 3 in FIG. 2 showing in detail the annular charging unit 4 according to the present invention.

As shown in FIG. 3 the electrode 3 is equipped with an electrode holder 7. Electric current is supplied to the electrode through wires 9. The electrode 3 runs through the charging unit 4. The lower part of the charging unit 4 consists of conical ring 12 which rests on the furnace roof 10. An element 13 constitutes the outer part of the charging unit 4. The element 13 also provides for a gas-tight seal between the furnace roof 10 and the electrode holder 7 by means of a ring shaped member 17.

The annular charging unit 4 further comprises an annular chamber 18. The annular chamber 18 has a bottom member 16, a substantially vertical concentric inner wall 14 and a substantially vertical concentric outer wall 15. The bottom member is resting on the conical ring 12 and the inner and outer walls 14, 15 are resting on the bottom member 16. The periphery of bottom member 16 has teeth which cooperate with a toothed wheel 19. The toothed wheel 19 can be rotated by means of a motor 20. Further the bottom member 16 has an opening 21. The purpose of the opening 21 in the bottom member 16 will be described below.

The annular chamber 18 consisting of the inner and outer walls 14, 15 and the bottom member 16, has the shape of an open box where the inner and outer walls 14, 15 are connected by means of a plurality of bars 22. Between the lower part of the inner wall 14 and the lower part of the outer wall 15, there is arranged at least one horizontal sheet 23. The sheet 23 is fixed to the walls 14, 15 and is intended to close the opening 21 in the bottom 16.

For feeding charge to the annular charging unit 4, at least one feeding pipe 5 runs through the element 13 into the annular chamber 18. The feeding pipe 5 connects the silo 6 to the annular chamber 18.

On the inside of the vertical part of the element 13 there is arranged a first member 24 which is intended to cooperate with a second member 25 arranged on the outside of the outer wall 15. The function of this first and second member 24, 25 will be evident from the description of the operation of the charging apparatus according to the present invention.

A preferred cycle for charging the furnace will now be described with reference to the figures.

As mentioned above in connection with FIG. 3, the bottom member 16 of the annular chamber 18 can be rotated without simultaneous rotation of the inner and outer walls 14, 15 which are resting on the bottom 16. The walls 14, 15 with the cover sheet 23 can, however, not rotate without the bottom member 16 being rotated.

In starting position the annular chamber 18 is in the position where the cover sheet 23 closes the opening 21 in the bottom 16, and the first member 24 on the vertical part of the element 13 is then always in engagement with the second member 25 on the outer wall 15.

The operation of motor 20 rotates the annular chamber 18. That is, the bottom member 16 is being rotated and the inner and outer walls 14, 15 resting on the bottom 16 will then also rotate. The second member 25 on the outer wall 15 will move away from the first member 24 on the element 13. As the annular chamber 18 rotates, the charge in the feeding pipe 5 will be distributed in the annular chamber 18. When the annular chamber 18 has rotated 360° the second member 25 will again come into engagement with the first member 24. The annular chamber 18 is now completely filled with charge. Upon continued rotation of the bottom member 16 in the same direction, the first member 24 will prevent the second member 25 from futher rotation and thereby the outer and inner concentric walls 14, 15, and the cover sheet 23 are prevented from continued rotation. As only the bottom member 16 now rotates, the opening 21 in the bottom 16 will be opened, and the charge in the annular chamber 18 will fall into the furnace through the opening 21.

When the bottom member 16 has rotated another 360° all the charge in the annular chamber 18 has been fed into the furnace. In this position the cover sheet 23 is again closing the opening 21 in the bottom 16. The outer and inner concentric walls with the cover sheet 23 have now rotated 360° while the bottom 16 has rotated $2\times360°$ in the same direction.

Now the direction of rotation is reversed. With this reversal the second member 25 will again move away from the first member 24. The annular chamber 18 with the inner and outer walls 14, 15 and the bottom member 16 will now rotate and the annular chamber 18 will again be filled with charge from the feeding pipe 5, until the second member 25 again comes into engagement with the first member 24. With continued rotation in the same direction only the bottom member 16 will rotate and the charge will be fed to the furnace through the opening 21 in the bottom 16.

To meet the need for different rates of consumption of charge around an electrode, the charging apparatus according to the present invention can be implemented as follows:

The position of the annular chamber 18 is as described above, that is the annular chamber is filled with charge, and the second member 25 is in engagement with the first member 24. The annular chamber 18 is divided into a plurality of charging zones. For charging one of the charging zones the bottom member 16 and the inner and outer walls 14, 15 are rotated in the direction opposite the direction the annular chamber 18 was rotated for feeding charge to the chamber 18. The annular chamber 18 is rotated until a signal establishes that the annular chamber 18 is in the right position for the chosen charging zone. In this position the rotation of the inner and outer walls 14, 15 and hence the cover sheet 23 is stopped, the direction of rotation is reserved, and the bottom 16 is rotated separately. Hence the opening 21 in the bottom 16 is laid open and charge is fed into the furnace for the chosen charging zone. When charging of the chosen charging zone is finished, the rotation of the bottom is stopped. The direction of rotation is then again reversed and the bottom member 16 is rotated until the opening 21 in the bottom 16 is closed by the cover sheet 23. The walls 14, 15 are then released for rotation and the annular chamber 18 starts to rotate back to the starting position. While the annular chamber 18 is returning to the starting position, charge is fed to the empty zone.

In this further embodiment of the present invention the inner and outer walls 14, 15 are equipped with means that make it possible to rotate the walls 14, 15 independently of the bottom member 16. This can be done by means of toothed wheels or other conventional transmission means.

According to another embodiment of the present invention the annular chamber 18 can be equipped with a plurality of feeding pipes. The lower ends of the feeding pipes have valves or other conventional means to close the pipes. With operation of the valves, zone charging with different raw material mix can be done in an easy way.

What is claimed:

1. Apparatus for charging an electrothermic smelting furnace having a plurality of electrodes comprising annular chambers concentrically arranged about each of the electrodes, each said annular chamber including a bottom member, a substantially concentric inner wall and outer wall, the bottom member and the walls being rotatable relative to the electrode, said bottom member having at least one opening communicating with the furnace pot and means for closing said opening wherein the bottom member and the walls of the chamber are rotatable relative to one another and wherein the means for closing comprises a horizontal sheet which is secured to the lower ends of said inner and outer walls and wherein the bottom member is rotatable by means for rotating said bottom member relative to said electrode and further comprising a stop member operative to prevent further rotation of the inner and outer walls while the bottom member continues its rotation.

2. Apparatus for charging an electrothermic smelting furnace having at least one electrode comprising an annular chamber concentrically disposed about the electrode and rotatable with respect thereto, said annular chamber including a bottom member, said bottom member having at least one opening therein for communication with the furnace, inner and outer concentric walls resting on said member, means for closing said opening in the bottom member and means for rotating said annular chamber wherein the walls and bottom member of said annular chamber are rotatable with respect to each other and wherein the bottom member is driven by said means for rotating and further comprising a stop member for preventing further rotation of said walls while the bottom member continues to rotate.

3. Apparatus for charging an electrothermic smelting furnace having at least one electrode comprising an annular chamber concentrically disposed about the electrode and rotatable with respect thereto, said annular chamber including a bottom member, said bottom member having at least one opening therein for communication with the furnace, inner and outer concentric walls resting on said member, means for closing said opening in the bottom member and means for rotating said annular chamber wherein the walls and bottom member of said annular chamber are rotatable with respect to each other and wherein the bottom member is driven by said means for rotating and further comprising a stop member for preventing further rotation of said walls while the bottom member continues to rotate and wherein the means for closing said opening in the bottom member is a horizontal sheet secured to the walls of the annular chamber, said sheet covering said opening and wherein the further rotation of the bottom member moves said opening from under horizontal sheet whereby the charge in the chamber is allowed to fall into the furnace.

4. In an electrothermic smelting furnace having at least one electrode, a chamber surrounding said electrode for feeding charge into said furnace said chamber having an inner wall, an outer wall positioned in spaced relationship to said inner wall, a bottom member having at least one aperture therein and a closure member to open and close said aperture for feeding charge down into the furnace, the method which comprises the steps of:

(a) causing relative rotation around the electrode between said bottom member and closure member to bring said closure member into a first position to close said aperture;

(b) simultaneously rotating said bottom member and closure member together around the electrode with the closure member in position closing said aperture while feeding furnace charge into said chamber;

(c) causing relative rotation around the electrode between said bottom member and closure member to bring said closure member into a second position to open said aperture whereby charge in the chamber is free to drop down through said aperture into the furnace.

5. The method of claim 4 which includes the steps of simultaneously rotating said inner and outer walls of said chamber together with said closure member and bottom member in one direction while feeding furnace charge into said chamber and separately rotating said bottom member in the same one direction to provide relative rotation between said bottom member and closure member to open the aperture and drop charge down through the aperture into the furnace.

6. The method of claim 4 which includes the steps of simultaneously rotating said bottom member, closure member and the inner and outer walls of said chamber together through 360 degrees in one direction while feeding furnace charge into said chamber and separately rotating said bottom member through an additional 360 degrees in the same one direction to provide relative rotation between said bottom member and closure member to open said aperture and drop charge down through the aperture into the furnace.

7. The method of claim 4 which includes the step of simultaneously rotating said inner and outer walls of said chamber together with said closure member and bottom member in one direction while feeding furnace charge into said chamber and separately rotating said bottom member in a second direction opposite to said one direction to provide relative rotation between said bottom member and closure member to open the aperture and drop charge down through the aperature into the furnace.

8. The method of claim 4 which includes the step of feeding furnace charge down through said aperture into the furnace by rotating said closure member and inner and outer walls of said chamber simultaneously together in one direction while said bottom member is separately rotated in a second opposite direction.

9. The method of claim 4 which includes the steps of enclosing the top of said chamber and establishing a gas seal between the top closure and the electrode.

10. Apparatus for feeding charge to an electrothermic smelting furnace having at least one electrode therein which comprises a chamber surrounding said at least one electrode said chamber having an inner wall and an outer wall positioned in spaced relationship to said inner wall and having a bottom member with at least one aperture therein for feeding charge down into the furnace, a closure member for opening and closing said aperture, first means for rotating said bottom member and closure member simultaneously together around the electrode with the closure member in a first position closing said aperture, second means for feeding furnace charge into said chamber, third means for causing relative rotation around the electrode between said aperature and closure member to bring said closure member into said first position to close said aperture and into a second position where the aperture is open and charge in the chamber is free to drop down through the aperture into the furnace.

11. The apparatus of claim 10 in which the closure member is mounted between the inner and outer walls of said chamber and in which said first means rotate the inner and outer walls simultaneously together with said closure member.

12. The apparatus of claim 10 which includes fourth means for closing the top open mouth of said chamber and for establishing a seal against loss of furnace gas from the top of said chamber.

* * * * *